US010118282B2

(12) United States Patent
Öberg

(10) Patent No.: US 10,118,282 B2
(45) Date of Patent: Nov. 6, 2018

(54) IMPULSE WRENCH WITH PUSH START FEATURE

(71) Applicant: ATLAS COPCO INDUSTRIAL TECHNIQUE AB, Stockholm (SE)

(72) Inventor: Hans Niklas Öberg, Nacka (SE)

(73) Assignee: Atlas Copco Industrial Technique AB, Stockholm (SE)

( * ) Notice: Subject to any disclaimer, the term of this patent is extended or adjusted under 35 U.S.C. 154(b) by 436 days.

(21) Appl. No.: 14/647,594

(22) PCT Filed: Dec. 10, 2013

(86) PCT No.: PCT/EP2013/076009

§ 371 (c)(1),
(2) Date: May 27, 2015

(87) PCT Pub. No.: WO2014/095472

PCT Pub. Date: Jun. 26, 2014

(65) Prior Publication Data

US 2015/0298305 A1 Oct. 22, 2015

(30) Foreign Application Priority Data

Dec. 21, 2012 (SE) ..... 1251507

(51) Int. Cl.
*B25B 23/147* (2006.01)
*B25B 21/02* (2006.01)
*B25F 5/00* (2006.01)

(52) U.S. Cl.
CPC ..... *B25B 23/147* (2013.01); *B25B 21/02* (2013.01); *B25F 5/00* (2013.01)

(58) Field of Classification Search
CPC ..... B25D 11/04; B25D 16/00; B25B 23/147; B25B 23/1475
(Continued)

(56) References Cited

U.S. PATENT DOCUMENTS 2,592,649 A * 4/1952 Brackett ..... B21D 39/16 173/170
3,418,504 A * 12/1968 Paule ..... B23B 45/001 310/43
(Continued)

FOREIGN PATENT DOCUMENTS

DE 3121275 A1 12/1982
EP 1369206 A1 12/2003
(Continued)

OTHER PUBLICATIONS

International Search Report (ISR) dated Jun. 17, 2014 issued in International Application No. PCT/EP2013/076009.

*Primary Examiner* — Robert Long
(74) *Attorney, Agent, or Firm* — Holtz, Holtz & Volek PC

(57) ABSTRACT

An Impulse wrench includes: a housing, a motor with a stator and a rotor, an impulse unit including an output shaft, a power control unit connected to the motor, and a trigger supported on the housing and connected to the power control unit and arranged to selectively deliver signals to activate the power control unit, wherein the impulse unit including the output shaft is axially displaceable in relation to the housing. The trigger includes a sensor arranged to be activated and deliver signals in response to axial displacements of the impulse unit including the output shaft relative to the housing, and the power control unit is arranged to control the motor operation in response to signals received from said sensor.

16 Claims, 2 Drawing Sheets

(58) Field of Classification Search
USPC ..... 173/2, 4, 93.5, 109, 176–178
See application file for complete search history.

(56) References Cited

U.S. PATENT DOCUMENTS 3,920,082 A * 11/1975 Dudek ..... B25B 21/00 173/182
3,985,188 A * 10/1976 Steele ..... B25C 7/00 173/170
4,073,352 A * 2/1978 Underwood ..... E21B 3/04 173/165
4,087,083 A * 5/1978 Kozuka ..... B25J 9/045 266/271
4,265,320 A * 5/1981 Tanaka ..... B25B 23/147 173/178
4,573,379 A * 3/1986 Bald ..... B23B 29/03432 279/134
4,844,177 A * 7/1989 Robinson ..... B25B 21/00 173/169
5,258,698 A * 11/1993 Piovano ..... G05B 19/402 219/121.7
5,315,789 A * 5/1994 Takashi ..... B24B 51/00 451/11
5,492,185 A * 2/1996 Schoeps ..... B25B 23/1453 173/177
5,701,961 A 12/1997 Warner et al.
6,123,243 A * 9/2000 Pfister ..... B25C 1/14 173/211
6,883,617 B2 * 4/2005 Putney ..... B25B 23/1453 173/1
6,923,268 B2 * 8/2005 Totsu ..... B25B 21/00 173/170
6,997,367 B2 * 2/2006 Hu ..... B25C 1/06 173/202
7,322,502 B1 * 1/2008 Sun ..... B25C 1/008 227/131
7,520,414 B2 * 4/2009 Blessing ..... B25C 1/06 173/117
7,740,369 B2 * 6/2010 Gabriel ..... B25B 21/00 362/119
8,381,960 B2 * 2/2013 Bruggmueller ..... B25C 1/06 124/17
9,296,099 B2 * 3/2016 Chen ..... B25F 5/02
2002/0148299 A1 * 10/2002 Leong ..... B23P 19/042 73/761
2003/0061921 A1 * 4/2003 Chen ..... B23D 59/001 83/13
2004/0089528 A1 5/2004 Totsu et al.
2007/0039748 A1 * 2/2007 Kennett ..... E04H 17/263 173/117
2008/0111434 A1 * 5/2008 Head ..... E21B 43/128 310/87
2008/0121404 A1 * 5/2008 Spasov ..... B25C 1/06 173/202
2008/0196912 A1 * 8/2008 Gass ..... B23B 31/123 173/4
2008/0289440 A1 * 11/2008 Denk ..... H02K 7/09 74/89.34
2009/0065226 A1 * 3/2009 John ..... B25D 11/005 173/6
2009/0133894 A1 5/2009 Mizuhara et al.
2010/0071920 A1 * 3/2010 Lau ..... B25F 5/00 173/1
2010/0236802 A1 * 9/2010 Berger ..... B25D 11/064 173/118
2011/0101064 A1 * 5/2011 Wolf ..... B25C 1/08 227/9
2011/0132630 A1 * 6/2011 Kawamura ..... B25B 21/00 173/178
2013/0000938 A1 * 1/2013 Matsunaga ..... B25B 21/008 173/181
2013/0062088 A1 * 3/2013 Mashiko ..... B25B 21/026 173/2
2013/0092409 A1 * 4/2013 Ullrich ..... B25B 21/02 173/18
2014/0045653 A1 * 2/2014 Atsumi ..... B25F 5/001 477/115
2015/0263579 A1 * 9/2015 Sengiku ..... H02K 3/522 310/50
2016/0325414 A1 * 11/2016 Mizuno ..... B25B 21/02

FOREIGN PATENT DOCUMENTS

GB 2240632 A 8/1991
WO 2007029729 A1 3/2007

* cited by examiner

IMPULSE WRENCH WITH PUSH START FEATURE

The invention relates to a power wrench of the impulse type which comprises a housing, a rotation motor with a stator and a rotor, an impulse unit with an output shaft, a power control unit connected to the motor, and a trigger means supported on the housing and connected to the power control unit and arranged to selectively deliver signals to activate the power control unit.

The problem being solved by the invention is to provide an impulse wrench with a so called push start function by which the operation efficiency of the tool is substantially increased. Instead of having to manually operate one or more triggers at each tightening object to control the power supply to the motor, the invention makes it possible for the operator just to press the tool against a threaded fastener to start the motor. This will speed up the assembly process in many applications.

The push start feature per se is well known in prior art and has been previously used in continuous torque delivering power nutrunners and screw drivers. This feature means that the operator does not have to press a trigger to initiate power supply to the motor when starting a screw joint tightening process but could accomplish the same function just by pressing the wrench axially against the screw joint to be tightened. Thereby, the output shaft and associated parts are displaced axially in relation to the wrench housing and initiate power supply to the motor. It also means that when a tightening process is completed the power supply to the motor is shut off as the axial force on the wrench housing is discontinued and the output shaft and associated parts are allowed to return to their initial positions.

It is an object of the invention is to implement a push start feature on an impulse type power wrench to thereby facilitate handling of this type of power tools.

Further objects and advantages of the invention will appear from the following specification and claims.

A preferred embodiment of the invention is below described in detail with reference to the accompanying drawings.

IN THE DRAWINGS

Figure 1:
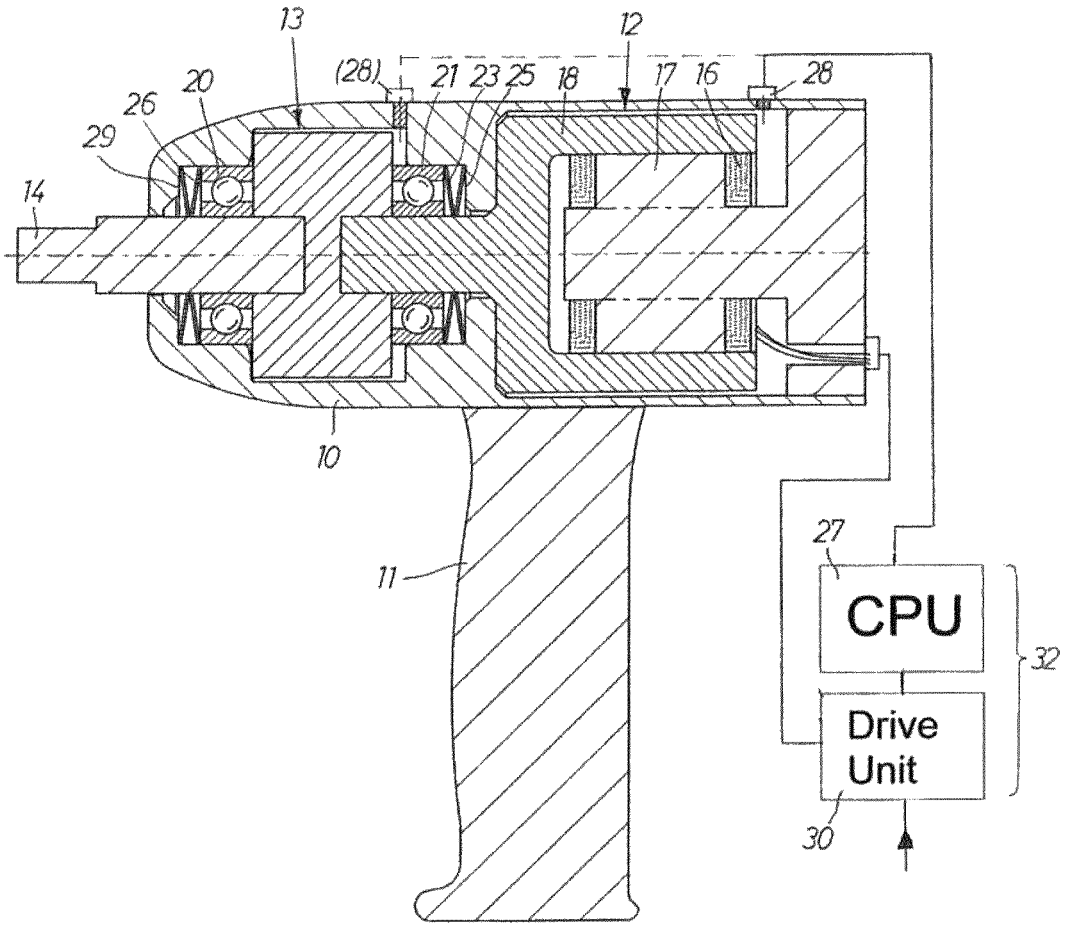
FIG. 1 shows a longitudinal section through an impulse wrench according to the invention with the drive unit occupying its forward most position.

The impulse wrench illustrated in the drawings is a hand held tool comprising a housing 10 with a handle 11, an electric motor 12, a hydraulic pulse unit 13 with an output shaft 14. The motor 12 comprises a stator 17 with motor windings 16, and a rotor 18, wherein the stator 17 is surrounded by the rotor 18 and rigidly connected to the housing 10. The rotor 18 and the pulse unit 13 are rotatively supported in the housing 10 by two bearings 20, 21 which are axially displaceable relative to the housing 10.

Figure 2:
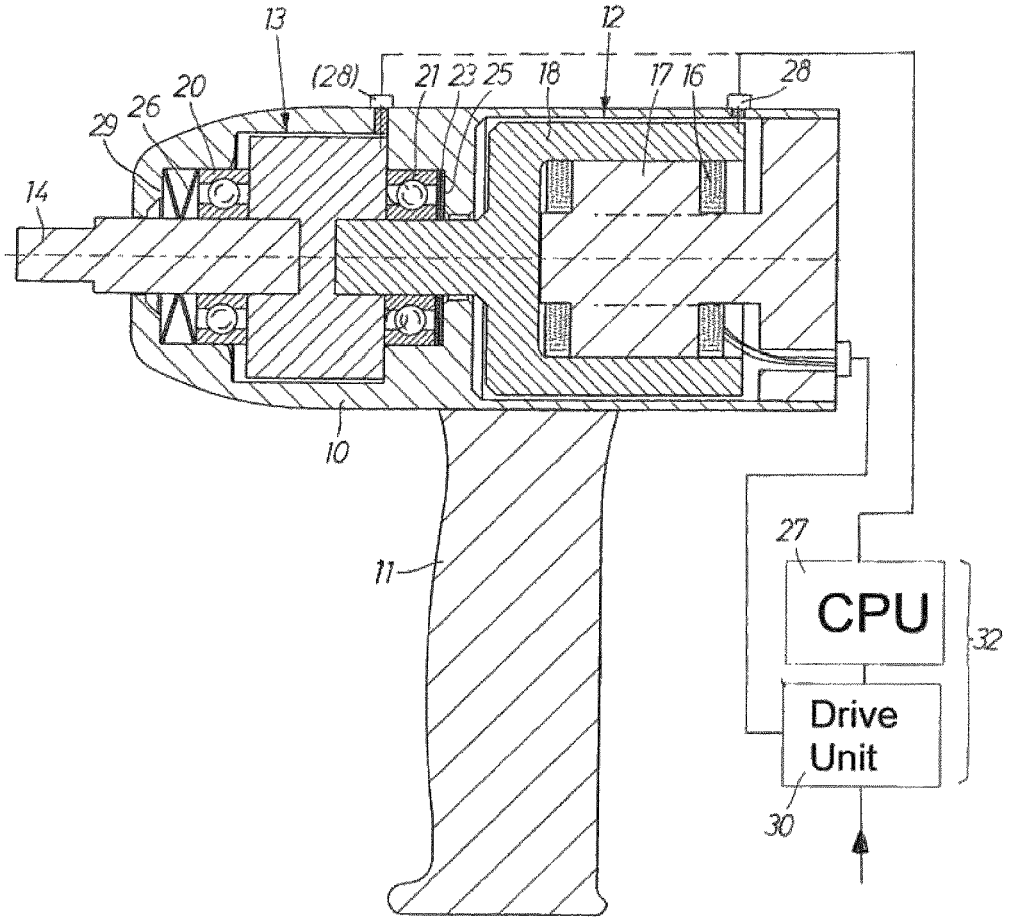
FIG. 2 shows the same view as FIG. 1 but with the drive unit in its rear position.

The rotor 18, the pulse unit 13 and the output shaft 14 are rigidly connected to each other and form together a rotary unit. Due to the axial movability of the two bearings 20, 21 the entire rotary unit is axially displaceable relative to the housing 10 between a forward rest position (FIG. 1) and a rear activated work position (FIG. 2). A spring 23 is arranged between the rear bearing 21 and a shoulder 25 in the housing 10 to exert a forward directed bias force on the pulse unit 13 and thereby on the entire the rotary unit. Another weaker spring 26 is located between the forward bearing 20 and a shoulder 29 for accomplishing together with the spring 23 an axial bias force on the bearings 20, 21 to thereby eliminate axial play in the bearings. Both springs 23 and 26 comprise Belleville springs, i.e. a stack of two or more conical spring washers.

At the rear part of the housing 10 there is mounted a sensor 28 which is arranged to indicate the axial position of the rotary unit by identifying the rear end portion of the rotor 12. The sensor 28 has the function of a trigger to initiate power supply to the motor 12 as the rotary unit is displaced to its rear active position. The sensor 28 is of the inductive type and reacts on the rotor 12 being displaced into a coinciding position. See FIG. 2. A CPU 27 is connected to the sensor 28 and arranged to initiate power supply to the motor 12 as a signal is received from the sensor 28. To that end the CPU 27 is connected to a drive unit 30 which communicates both with a power source and the motor windings 16. The latters are fed with a three phase voltage for energizing the motor 12. The CPU 27 and the drive unit 30 form together a power control unit 32.

In operation of the wrench the drive unit initially occupies its forward rest position due to the action of spring 23, (FIG. 1), wherein the rotor 12 is out of reach for the sensor 28. This means that no power supply initiating signal is sent to the CPU 27 and that the motor 12 will remain inactive. When the wrench is put to work on a threaded fastener to be tightened the operator applies an axial push force on the housing handle 11 which, whereby a reaction force from the fastener on the output shaft 14 will dominate the bias force of the spring 23 and result in a rearward displacement not only of the output shaft 14 but of the entire rotary unit relative to the housing 10. This means that the motor rotor 18 will be moved into a sensor 28 activation position, (FIG. 2), and that a power supply signal is sent from the sensor 28 to the CPU 27 to activate the drive unit 30 to deliver power to the motor 12. Now, the motor 12 starts delivering a torque to the fastener via the pulse unit 13 and the output shaft 14. This will continue until a set target torque level is reached in the fastener, whereat the CPU 27 will initiate discontinuation of the power supply from the drive unit 30 to the motor 12. As the tightening process is completed the operator lifts the wrench off the fastener which means that the axial force on the housing 10 is discontinued and that the spring 23 will be able to return the rotary unit 24 to the forward inactive position, (FIG. 1), wherein the rotor 18 no longer can activate the sensor 28. This results in a discontinuation of the power supply signal to the CPU 27 and a power shut-off to the motor 12 is accomplished. A push started power wrench operation is completed.

In the drawings there is indicated an alternative location of the sensor 28, namely in the front part of the housing 10 close to the pulse unit 13, such that axial displacements of the latter including the output shaft 14 will make the sensor 28 generate power control signals to the CPU 27.

It is to be noted that the invention also includes embodiments other than the one described above. One such alternative embodiment comprises an arrangement of the rotary parts wherein the pulse unit 13 including the output shaft 14 is axially displaceable whereas the motor rotor 18 is not. This is due to a splines connection (a sliding coupling) arranged between the motor rotor 18 and the pulse unit 13. This means that the rotary unit is divided into two parts, whereof one is axially displaceable and the other is not. In this case the displacement sensor 28 is located in the front part of the housing 10, as described above, so as to be activated by the pulse unit 13 at axial displacements of the latter and the output shaft 14.

Although not illustrated in the drawings the power source to be used for energizing the power wrench may be a mains connection or a battery as preferred or suitable for the actual wrench design.

The invention claimed is:

1. An impulse wrench comprising:
a housing,
a motor with a stator and a rotor,
a hydraulic pulse unit including an output shaft,
a power control unit connected to the motor, and
a sensor which selectively delivers signals to activate the power control unit,
wherein:
the hydraulic pulse unit including the output shaft is axially displaceable in relation to the housing,
the sensor is supported on the housing,
the sensor is activated and delivers the signals in response to axial displacements of the hydraulic pulse unit including the output shaft relative to the housing,
the power control unit controls the motor operation in response to the signals received from the sensor,
the rotor and the hydraulic pulse unit including the output shaft are axially locked to each other to form a rotary unit,
the rotary unit is axially displaceable as a whole relative to the housing, and
the sensor is configured to be activated by the rotor to initiate power supply to the motor.

2. The impulse wrench according to claim 1, further comprising:
a spring which applies a forward directed bias force on the rotary unit, relative to the housing,
wherein the spring is configured to be dominated by an axial push force applied on the housing to accomplish a rearward displacement of the rotary unit, in response to which the sensor outputs a power supply initiating signal.

3. The impulse wrench according to claim 1, wherein the power control unit is configured to supply power to the motor as a signal is received from the sensor indicating a rearward displacement of the rotary unit, and to shut-off power supply to the motor as a signal is received indicating a forward displacement of the rotary unit.

4. An impulse wrench comprising:
a housing,
a motor with a stator and a rotor,
a hydraulic pulse unit including an output shaft,
a power control unit connected to the motor, and
a sensor which selectively delivers signals to activate the power control unit,
wherein:
the hydraulic pulse unit including the output shaft is axially displaceable in relation to the housing,
the sensor is supported on the housing,
the sensor is activated and delivers the signals in response to axial displacements of the hydraulic pulse unit including the output shaft relative to the housing,
the power control unit controls the motor operation in response to the signals received from the sensor,
the rotor and the hydraulic pulse unit are interconnected by a sliding coupling,
the rotor is axially immovable and the hydraulic pulse unit including the output shaft is axially displaceable, and
the sensor is configured to be activated by the hydraulic pulse unit to initiate power supply to the motor.

5. The impulse wrench according to claim 3, further comprising:
a spring which applies a forward directed bias force on the rotary unit, relative to the housing,
wherein the spring is configured to be dominated by an axial push force applied on the housing to accomplish the rearward displacement of the rotary unit, in response to which the sensor outputs a power supply initiating signal.

6. The impulse wrench according to claim 3, wherein:
the motor is an electric motor,
the stator is a central part of the motor, and
the rotor is tubular and surrounds the stator.

7. The impulse wrench according to claim 2, wherein:
the motor is an electric motor,
the stator is a central part of the motor, and
the rotor is tubular and surrounds the stator.

8. The impulse wrench according to claim 1, wherein:
the motor is an electric motor,
the stator is a central part of the motor, and
the rotor is tubular and surrounds the stator.

9. The impulse wrench according to claim 4, wherein:
the motor is an electric motor,
the stator is a central part of the motor, and
the rotor is tubular and surrounds the stator.

10. The impulse wrench according to claim 5, wherein:
the motor is an electric motor,
the stator is a central part of the motor, and
the rotor is tubular and surrounds the stator.

11. The impulse wrench according to claim 4, wherein the power control unit is configured to supply power to the motor as a signal is received from the sensor indicating a rearward displacement of the hydraulic pulse unit including the output shaft, and to shut-off power supply to the motor as a signal is received indicating a forward displacement of the hydraulic pulse unit including the output shaft.

12. The impulse wrench according to claim 4, further comprising:
a spring which applies a forward directed bias force on the hydraulic pulse unit including the output shaft, relative to the housing,
wherein the spring is configured to be dominated by an axial push force applied on the housing to accomplish a rearward displacement of the hydraulic pulse unit including the output shaft, in response to which the sensor outputs a power supply initiating signal.

13. The impulse wrench according to claim 11, further comprising:
a spring which applies a forward directed bias force on the hydraulic pulse unit including the output shaft, relative to the housing,
wherein the spring is configured to be dominated by an axial push force applied on the housing to accomplish the rearward displacement of the hydraulic pulse unit including the output shaft, in response to which the sensor outputs a power supply initiating signal.

14. The impulse wrench according to claim 11, wherein:
the motor is an electric motor,
the stator is a central part of the motor, and
the rotor is tubular and surrounds the stator.

15. The impulse wrench according to claim 12, wherein:
the motor is an electric motor, the stator is a central part of the motor, and
the rotor is tubular and surrounds the stator.

16. The impulse wrench according to claim 13, wherein:
the motor is an electric motor,
the stator is a central part of the motor, and
the rotor is tubular and surrounds the stator.

* * * * *